US007127336B2

(12) United States Patent
Houpt et al.

(10) Patent No.: US 7,127,336 B2
(45) Date of Patent: Oct. 24, 2006

(54) METHOD AND APPARATUS FOR CONTROLLING A RAILWAY CONSIST

(75) Inventors: Paul Kenneth Houpt, Schenectady, NY (US); Harry Kirk Mathews, Jr., Clifton Park, NY (US); Sunil Shirish Shah, Bangalore (IN)

(73) Assignee: General Electric Company, Niskayuna, NY (US)

( * ) Notice: Subject to any disclaimer, the term of this patent is extended or adjusted under 35 U.S.C. 154(b) by 299 days.

(21) Appl. No.: 10/670,891

(22) Filed: Sep. 24, 2003

(65) Prior Publication Data

US 2005/0065674 A1 Mar. 24, 2005

(51) Int. Cl.
*G05D 1/00* (2006.01)

(52) U.S. Cl. ..... 701/19; 701/20; 246/167 R

(58) Field of Classification Search ..... 701/19, 701/20, 213, 214, 216, 217, 220, 221; 246/122 R, 246/167 R See application file for complete search history.

(56) References Cited

U.S. PATENT DOCUMENTS

| | | | | |
|---|---|---|---|---|
| 4,344,364 | A | 8/1982 | Nickles et al. | 701/19 |
| 5,239,472 | A | 8/1993 | Long et al. | 701/20 |
| 6,144,901 | A | 11/2000 | Nickles et al. | 701/20 |
| 6,263,266 | B1 | 7/2001 | Hawthorne | 701/19 |
| 6,332,106 | B1 | 12/2001 | Hawthorne et al. | 701/19 |
| 6,502,033 | B1 * | 12/2002 | Phuyal | 701/214 |
| 6,641,090 | B1 * | 11/2003 | Meyer | 246/122 R |
| 2001/0029411 | A1 | 10/2001 | Hawthorne | 701/19 |
| 2003/0191568 | A1 * | 10/2003 | Breed | 701/36 |

FOREIGN PATENT DOCUMENTS

| | | |
|---|---|---|
| EP | 1136969 A2 | 9/2001 |
| WO | WO90/03622 | 4/1990 |
| WO | WO99/14093 | 3/1999 |
| WO | WO01/08955 A1 | 2/2001 |
| WO | WO01/08956 A1 | 2/2001 |
| WO | WO 01/08958 | 2/2001 |
| WO | WO01/08959 | 2/2001 |
| WO | WO01/20587 A2 | 3/2001 |

OTHER PUBLICATIONS

U.S. Appl. No. 10/177,547, filed Jun. 21, 2002, by Gerald Hess, Jr., et al., Entitled "Control and Method for Optimizing the Operation of Two or More Locomotives of a Consist".

U.S. Appl. No. 10/429,596, filed May 5, 2003, by Gerald Hess, Jr., T al., Entitled "System and Method for Managing Two or More Locomotives of a Consist".

"Select-A-Power, A Manual Fuel-Saving System for Simple, Positive Control", Harmon Electronics, Inc., Aug. 28, 1985, 7 pages.

* cited by examiner

*Primary Examiner*—Gertrude A. Jeanglaude
(74) *Attorney, Agent, or Firm*—Fletcher Yoder

(57) ABSTRACT

An apparatus for controlling a railway consist, the apparatus comprising: a consist model adapted for computing an objective function from a set of candidate driving plans and a set of model parameters; a parameter identifier adapted for calculating the model parameters from a set of consist measurements; and a trajectory optimizer adapted for generating the candidate driving plans and for selecting an optimal driving plan to optimize the objective function subject to a set of terminal constraints and operating constraints.

28 Claims, 3 Drawing Sheets

METHOD AND APPARATUS FOR CONTROLLING A RAILWAY CONSIST

BACKGROUND

The present invention relates generally to the field of controlling a railway consist and more specifically to the field of generating and tracking optimal consist driving profiles.

In freight train and other railway consist operations, fuel consumption constitutes a major operating cost to railroads and is also the ultimate source of any potentially harmful emissions. Reducing fuel consumption, therefore, directly increases railroad profit and directly reduces emissions. While modest fuel savings are possible by improving efficiencies of engines and other components in the locomotive propulsion chain, larger savings are generally expected to be achieved by improving strategies for how the train is driven. A train driving strategy specifying throttle or brake settings or desired consist speed as a function of distance along a route or as a function of time is referred to as a "driving plan".

Train schedules are determined by a central dispatcher and are frequently changed, to account for variability from numerous sources, often as a train is en route to a next decision point. At heavy traffic times, the schedule may have no schedule slack time and can only be met by continuous operation at prevailing railroad speed limits.

Frequently, however, the schedule does have at least some schedule slack time, allowing the engineer to drive at average speeds well below the speed limits and still arrive at subsequent decision points on time. Under such circumstances, it is possible to calculate an optimal driving plan that exploits the schedule slack time and minimizes fuel consumption, or an alternative objective function, subject to constraints of meeting the schedule and obeying the speed limits.

Opportunities exist, therefore, to provide train drivers with tools for generating driving plans and controlling railway consists to exploit schedule slack time and improve railway consist efficiency and performance.

SUMMARY

The opportunities described above are addressed, in one embodiment of the present invention, by an apparatus for controlling a railway consist, the apparatus comprising: a consist model adapted for computing an objective function from a set of candidate driving plans and a set of model parameters; a parameter identifier adapted for calculating the model parameters from a set of consist measurements; and a trajectory optimizer adapted for generating the candidate driving plans and for selecting an optimal driving plan to optimize the objective function subject to a set of terminal constraints and operating constraints.

The present invention is also embodied as a method for controlling a railway consist, the method comprising: computing an objective function from a set of candidate driving plans and a set of model parameters; calculating the model parameters from a set of consist measurements; and generating the candidate driving plans and selecting an optimal driving plan to optimize the objective function subject to a set of terminal constraints and operating constraints.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
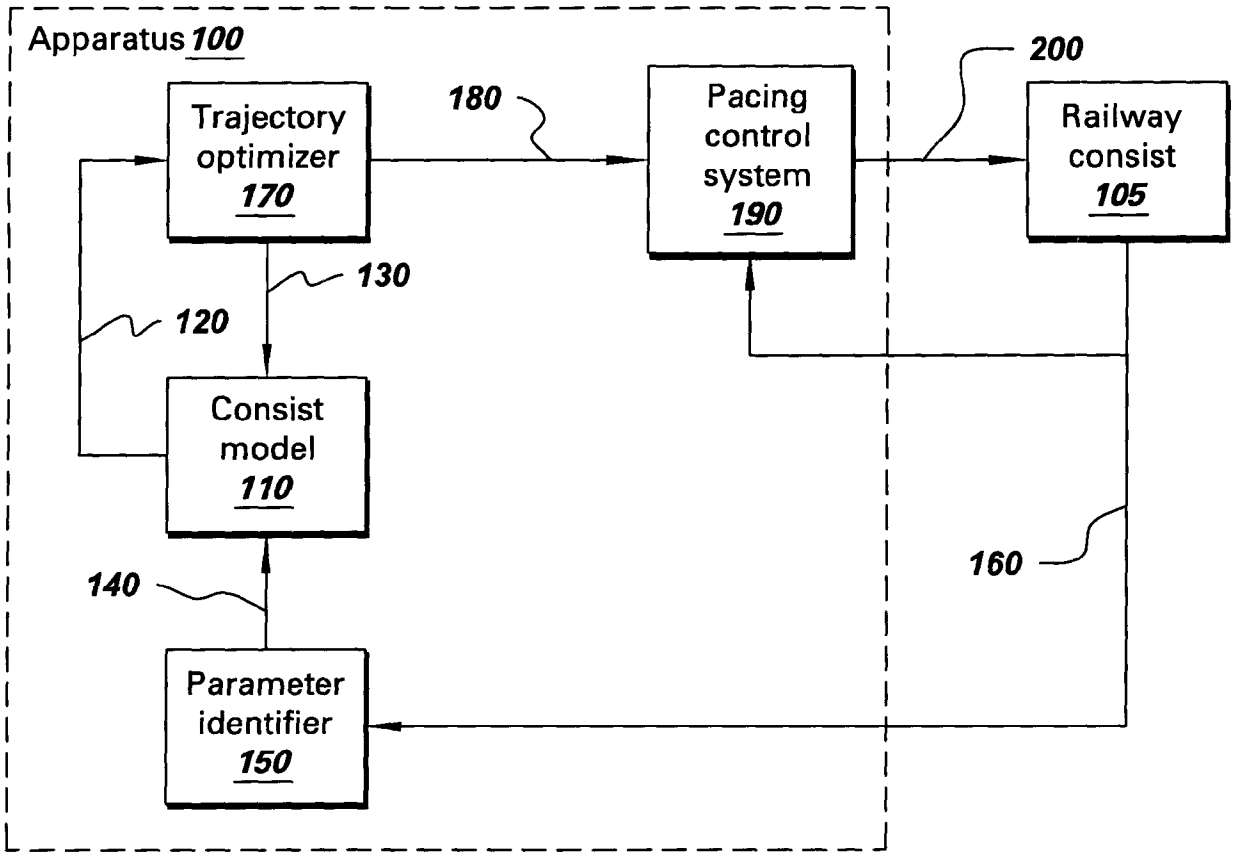
FIG. 1 illustrates a block diagram in accordance with one embodiment of the present invention.

In accordance with one embodiment of the present invention, FIG. 1 illustrates a block diagram of an apparatus 100 for controlling a railway consist 105. Apparatus 100 comprises a consist model 110, a parameter identifier 150, and a trajectory optimizer 170. In operation, consist model 110 computes an objective function 120 from a set of candidate driving plans 130 and from a set of model parameters 140. Parameter identifier 150 calculates model parameters 140 from a set of consist measurements 160. Trajectory optimizer 170 then generates candidate driving plans 130 and selects an optimal driving plan 180 to optimize objective function 120 subject to any terminal constraints and operating constraints.

As used herein, "optimize" refers to minimizing or maximizing, as appropriate. Examples of objective function 120 include, without limitation, fuel consumption, travel time, integral squared input rate, summed squared input difference, and combinations thereof. "Fuel consumption" and "travel time" refer respectively to the amount of fuel consumed and to the amount of time spent over an entire route or over any prescribed portion or portions of a route. In a continuous time implementation of consist model 110, "integral squared input rate" refers to an integral with respect to time of a squared time derivative of a driving plan throttle setting. In a discrete time implementation of consist model 110, "summed squared input difference" refers to a summation of a squared backward difference of driving plan throttle settings. Minimizing (i.e., penalizing) these functions of the input produces a smoother driving plan thereby improving train handling with respect to coupling slack management.

Examples of model parameters 140 include, without limitation, consist mass and consist drag force parameters including, without limitation, coefficients in polynomial approximations to consist drag force as a function of consist speed. Examples of consist measurements 160 include, without limitation, a consist position measurement, a consist speed measurement, a tractive effort signal, and a track slope (grade) signal. Examples of terminal constraints include, without limitation, time constraints for reaching prescribed places along the track (i.e., train schedules). Examples of operating constraints include, without limitation, maximum or minimum speed limits and maximum or minimum acceleration limits.

In a more specific embodiment in accordance with the embodiment of FIG. 1, objective function 120 is a quantity or linear combination of quantities selected from the group consisting of fuel consumption, travel time, integral squared input rate, and summed squared input difference.

In another more specific embodiment in accordance with the embodiment of FIG. 1, apparatus 100 further comprises a pacing control system 190 for generating throttle commands 200 from optimal driving plan 180 and consist measurements 160. In this embodiment, optimal driving plan 180 provides a speed set point and consist measurements 160 provide a speed feedback for a feedback control algorithm implemented in pacing control system 190.

Figure 2:
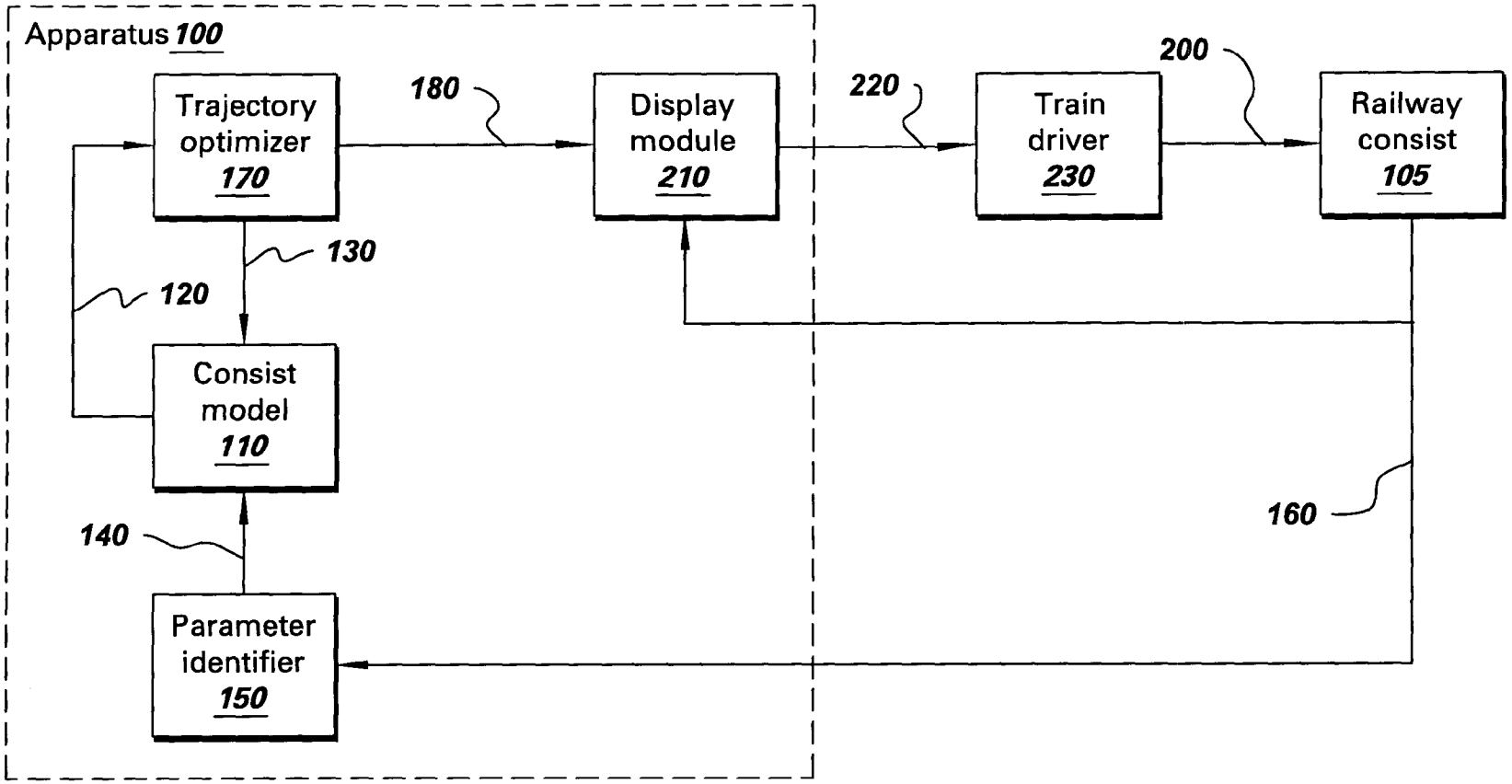
FIG. 2 illustrates a block diagram in accordance with another embodiment of the present invention.

In accordance with another embodiment of the present invention, FIG. 2 illustrates a block diagram wherein apparatus 100 further comprises a display module 210. In operation, display module 210 displays a formatted driving plan 220 derived from optimal driving plan 180 and consist measurements 160. The train driver uses formatted driving plan 220 to decide which throttle or brake settings to apply.

Figure 3:
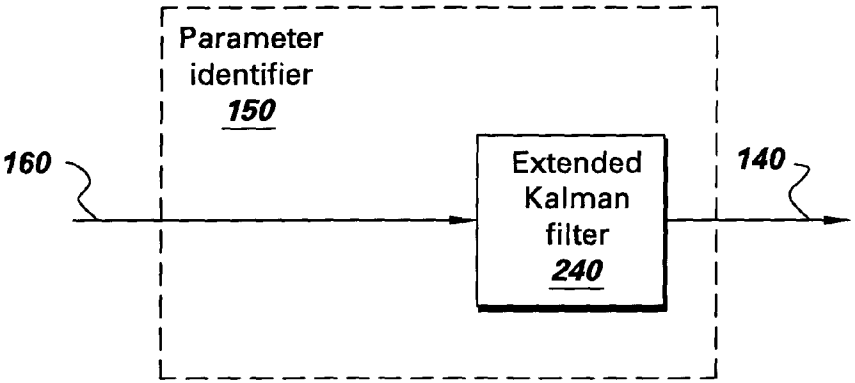
FIG. 3 illustrates a block diagram in accordance with a more specific embodiment of the embodiment of FIG. 1.

In accordance with a more specific embodiment of the embodiment of FIG. 1, FIG. 3 illustrates a block diagram wherein parameter identifier 150 comprises an extended Kalman filter 240. As used herein, "extended Kalman filter" refers to any apparatus for dynamic state estimation using a non-linear process model including, without limitation, extended observers.

In a more detailed embodiment in accordance with the embodiment of FIG. 3: extended Kalman filter 240 has an extended filter state vector comprising a consist position estimate, a consist speed estimate, and model parameters 140; and consist measurements 160 comprise a consist position measurement and a consist speed measurement.

Figure 4:
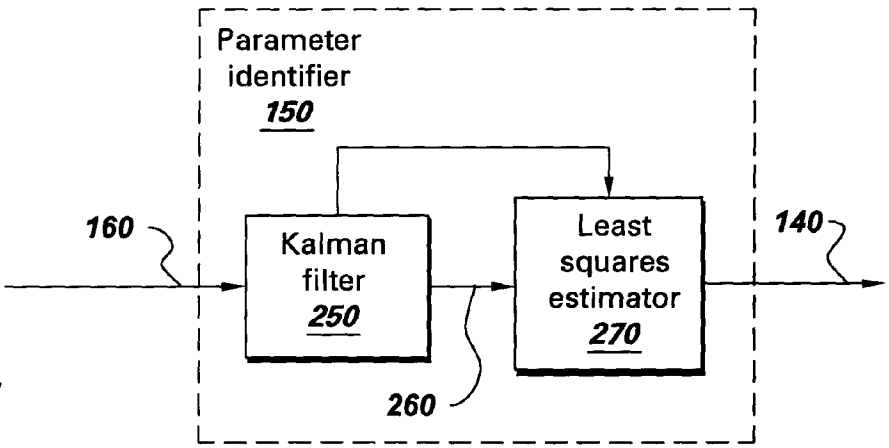
FIG. 4 illustrates a block diagram in accordance with another more specific embodiment of the embodiment of FIG. 1.

In accordance with another more specific embodiment of the embodiment of FIG. 1, FIG. 4 illustrates a block diagram wherein parameter identifier 150 comprises a Kalman filter 250 and a least squares estimator 270. In operation, Kalman filter 250 generates filter outputs 260 from consist measurements 160. Least squares estimator 270 estimates model parameters 140 from filter outputs 260 and consist measurements 160.

In a more detailed embodiment in accordance with the embodiment of FIG. 4: Kalman filter 250 has a filter state vector comprising a consist position estimate, a consist speed estimate, and a consist acceleration estimate; filter outputs 260 comprise the consist speed estimate and the consist acceleration estimate; and consist measurements 160 comprise a consist position measurement, a consist speed measurement, a tractive effort signal, and a track grade signal.

All of the above described elements of embodiments of the present invention may be implemented, by way of example, but not limitation, using singly or in combination any electric or electronic devices capable of performing the indicated functions. Examples of such devices include, without limitation: analog devices; analog computation modules; digital devices including, without limitation, small-, medium-, and large-scale integrated circuits, application specific integrated circuits (ASICs), and programmable logic arrays (PLAs); and digital computation modules including, without limitation, microcomputers, microprocessors, microcontrollers, and programmable logic controllers (PLCs).

In some implementations, the above described elements of the present invention are implemented as software components in a general purpose computer. Such software implementations produce a technical effect of controlling a railway consist so as to optimize a selected objective function.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus for controlling a railway consist, said apparatus comprising:

a consist model configured to compute an objective function from a set of candidate driving plans and a set of model parameters;

a parameter identifier configured to calculate said model parameters from a set of consist measurements; and a trajectory optimizer configured to generate said candidate driving plans and to select an optimal driving plan to optimize said objective function subject to a set of terminal constraints and operating constraints.

2. The apparatus of claim 1 further comprising a pacing control system configured to generate a set of throttle commands from said optimal driving plan and said consist measurements.

3. The apparatus of claim 1 further comprising a display module configured to display formatted driving plan from said optimal driving plan and said consist measurements.

4. The apparatus of claim 1 wherein said parameter identifier comprises an extended Kalman filter.

5. The apparatus of claim 4 wherein:

said extended Kalman filter has an extended filter state vector comprising a consist position estimate, a consist speed estimate, and said model parameters; and said consist measurements comprise a consist position measurement and a consist speed measurement.

6. The apparatus of claim 1 wherein said parameter identifier comprises:

a Kalman filter configured to generate a set of filter outputs from said consist measurements; and a least squares estimator configured to estimate said model parameters from said filter outputs and said consist measurements.

7. The apparatus of claim 6 wherein:

said Kalman filter has a filter state vector comprising a consist position estimate, a consist speed estimate, and a consist acceleration estimate;

said filter outputs comprise said consist speed estimate and said consist acceleration estimate; and said consist measurements comprise a consist position measurement, a consist speed measurement, a tractive effort signal, and a track grade signal.

8. The apparatus of claim 1 wherein said objective function is a quantity or linear combination of quantities selected from the group consisting of fuel consumption, travel time, integral squared input rate, and summed squared input difference.

9. An apparatus for controlling a railway consist, said apparatus comprising:

a consist model configured to compute an objective function from a set of candidate driving plans and a set of model parameters;

a parameter identifier configured to calculate said model parameters from a set of consist measurements;

a trajectory optimizer configured to generate said candidate driving plans and to select an optimal driving plan to optimize said objective function subject to a set of terminal constraints and operating constraints; and a display module configured to display a formatted driving plan from said optimal driving plan and said consist measurements, said objective function being a quantity or linear a combination of quantities selected from the group consisting of fuel consumption, travel time, integral squared input rate, and summed squared input difference.

10. The apparatus of claim 9 further comprising a pacing control system configured to generate a set of throttle commands from said optimal driving plan and said consist measurements.

11. The apparatus of claim 9 wherein said parameter identifier comprises an extended Kalman filter.

12. The apparatus of claim 11 wherein:

said extended Kalman filter has an extended filter state vector comprising a consist position estimate, a consist speed estimate, and said model parameters, and said consist measurements comprise a consist position measurement and a consist speed measurement.

13. The apparatus of claim 9 wherein said parameter identifier comprises:

a Kalman filter configured to generate a set of filter outputs from said consist measurements; and a least squares estimator configured to estimate said model parameters from said filter outputs and said consist measurements.

14. The apparatus of claim 13 wherein:

said Kalman filter has a filter state vector comprising a consist position estimate, a consist speed estimate, and a consist acceleration estimate;

said filter outputs comprise said consist speed estimate and said consist acceleration estimate, and said consist measurements comprise a consist position measurement, a consist speed measurement, a tractive effort signal, and a track grade signal.

15. A method for controlling a railway consist, said method comprising:

computing an objective function from a set of candidate driving plans and a set of model parameters;

calculating said model parameters from a set of consist measurements; and generating said candidate driving plans and selecting an optimal driving plan to optimize said objective function subject to a set of terminal constraints and operating constraints.

16. The method of claim 15 further comprising generating a set of throttle commands from said optimal driving plan and said consist measurements.

17. The method of claim 15 further comprising displaying a formatted driving plan from said optimal driving plan and said consist measurements.

18. The method of claim 15 wherein said act of calculating said model parameters comprises using an extended Kalman filter.

19. The method of claim 18 wherein:

said extended Kalman filter has an extended filter state vector comprising a consist position estimate, a consist speed estimate, and said model parameters; and said consist measurements comprise a consist position measurement and a consist speed measurement.

20. The method of claim 15 wherein said act of calculating said model parameters comprises:

using a Kalman filter for generating a set of filter outputs from said consist measurements; and using a least squares estimator for estimating said model parameters from said filter outputs and said consist measurements.

21. The method of claim 20 wherein:

said Kalman filter has a filter state vector comprising a consist position estimate, a consist speed estimate, and a consist acceleration estimate;

said filter outputs comprise said consist speed estimate and said consist acceleration estimate; and said consist measurements comprise a consist position measurement, a consist speed measurement, a tractive effort signal, and a track grade signal.

22. The method of claim 15 wherein said objective function is a quantity or linear combination of quantities selected from the group consisting of fuel consumption, travel time, integral squared input rate, and summed squared input difference.

23. A method for controlling a railway consist, said method comprising:

computing an objective function from a set of candidate driving plans and a set of model parameters;

calculating said model parameters from a set of consist measurements;

generating said candidate driving plans and selecting an optimal driving plan to optimize said objective function subject to a set of terminal constraints and operating constraints; and displaying a formatted driving plan from said optimal driving plan and said consist measurements, said objective function being a quantity or linear a combination of quantities selected from the group consisting of fuel consumption, travel time, integral squared input rate, and summed squared input difference.

24. The method of claim 23 further comprising generating a set of throttle commands from said optimal driving plan and said consist measurements.

25. The method of claim 23 wherein said act of calculating said model parameters comprises using an extended Kalman filter.

26. The method of claim 25 wherein:

said extended Kalman filter has an extended filter state vector comprising a consist position estimate, a consist speed estimate, and said model parameters; and said consist measurements comprise a consist position measurement and a consist speed measurement.

27. The method of claim 23 wherein said act of calculating said model parameters comprises:

using a Kalman filter for generating a set of filter outputs from said consist measurements, and using a least squares estimator for estimating said model parameters from said filter outputs and said consist measurements.

28. The method of claim 27 wherein:

said Kalman filter has a filter state vector comprising a consist position estimate, a consist speed estimate, and a consist acceleration estimate;

said filter outputs comprise said consist speed estimate and said consist acceleration estimate; and said consist measurements comprise a consist position measurement, a consist speed measurement, a tractive effort signal, and a track grade signal.

* * * * *